US006244029B1

(12) United States Patent
Bruss et al.

(10) Patent No.: US 6,244,029 B1
(45) Date of Patent: Jun. 12, 2001

(54) METHOD AND DEVICE FOR COVERING A SPUN YARN BODY

(75) Inventors: Karl-Heinz Bruss; Karl Koltze; Udo Schult, all of Monchengladbach; Karl-Heinz Klinkenberg, Herzogenrath-Strasch, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/449,188

(22) Filed: Nov. 24, 1999

(30) Foreign Application Priority Data

Nov. 27, 1998 (DE) ..... 198 54 786

(51) Int. Cl.[7] ..... D01H 1/08

(52) U.S. Cl. ..... 57/76; 57/67; 57/71; 57/267; 57/312; 242/911

(58) Field of Search ..... 57/67, 71, 76, 57/267, 312; 242/911

(56) References Cited

U.S. PATENT DOCUMENTS

| | | | |
|---|---|---|---|
| 5,515,672 | 5/1996 | Koltze et al. | 57/281 |
| 5,613,355 | 3/1997 | Koltze et al. | 57/312 |
| 5,699,658 | 12/1997 | Koltze et al. | 57/76 |
| 5,916,117 | 6/1999 | Koltze | 57/76 |

FOREIGN PATENT DOCUMENTS

| | | |
|---|---|---|
| 10 11 787 | 7/1957 | (DE) . |
| 4324039A1 | 1/1995 | (DE) . |
| 4426897A1 | 2/1996 | (DE) . |
| 19520153A1 | 12/1996 | (DE) . |
| 195 23 937 | 1/1997 | (DE) . |
| 19523937A1 | 1/1997 | (DE) . |
| 196 50 598 | 6/1998 | (DE) . |
| 19650598A1 | 6/1998 | (DE) . |
| 755 131 | 8/1956 | (GB) . |
| 62-162027 | 7/1987 | (JP) . |

OTHER PUBLICATIONS

Foreign Search Report.
Abstract of DE19520153.
Abstract of DE19523937.
European Search Report.

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A method and a device for winding a spun yarn body from an inside wall of a spinning centrifuge of a pot spinning machine onto a tube (10) introduced for such purpose into the spinning centrifuge. The yarn extending between a yarn guide tube (6) and the inside wall of the spinning centrifuge is caught by lowering the tube past the mouth of the yarn guide tube and the winding process initiated. A remnant of spinning yarn is created thereby between the draw frame and the tube foot. In order to avoid disturbances due to the free end of this remnant of spinning yarn, the remnant of spinning yarn is separated from the yarn body and the tube and subsequently removed by suction.

16 Claims, 4 Drawing Sheets

METHOD AND DEVICE FOR COVERING A SPUN YARN BODY

CROSS-REFERENCE TO RELATED APPLICATIONS

This application claims the benefit of German Application DE 19854786.2, filed Nov. 27, 1998, herein incorporated by reference.

FIELD OF THE INVENTION

The present invention relates to a method for winding a body or cake of a spun yarn formed in a spinning centrifuge of a pot spinning machine onto a tube. The present invention also relates to a device for implementing the method of the present invention.

BACKGROUND OF THE INVENTION

In pot spinning, the yarn, deposited in the spinning centrifuge or the spinning pot as spinning cake, is wound after the end of the actual spinning process onto a previously introduced tube so that a spinning cop is produced. An empty tube is used for this which is held ready on the yarn guide tube during the actual spinning process and is lowered past the mouth of the yarn guide tube for initiating the winding process of the yarn body deposited on the inner wall of the spinning centrifuge.

The tube edge catches the rotating yarn shank exiting out of the yarn guide tube thereby, for example in a slot arranged on the lower edge of the tube, and prevents this shank from rotating further in this manner with the consequence that the yarn body deposited on the inner wall of the spinning centrifuge and rotating further with it loops around the tube and is rewound therewith onto the empty tube.

Due to lacking further rotation, the yarn separates from the draw frame when the draw frame supplies more material or is cut off, as is disclosed in German Patent Publication DE 43 24 039 A1, by a clamping and cutting device directly in the direction of yarn travel behind the draw frame. However, the yarn remains fastened on the tube, forms a trailing yarn or remnant of spinning yarn and can have a disturbing influence with its free end, which can be, for example half a meter long, at the spinning position or during the further handling of the tube or of the spinning cop.

SUMMARY OF THE INVENTION

It is accordingly an object of the present invention to solve the problem of how to eliminate the aforementioned sources of disturbance in a pot spinning machine.

The present invention solves this problem by providing a novel method and a device for winding a body of a spun yarn from an inner wall of a spinning centrifuge of a pot spinning machine onto a winding tube surrounding a yarn guide tube. The winding tube has a slot at its foot and the yarn guide tube has a leading end extending into the spinning centrifuge with a mouth from which the spun yarn travels to the inner wall of the centrifuge.

In accordance with the present invention, the foot of the winding tube is inserted into the spinning centrifuge beyond the mouth of the yarn guide tube. In such disposition, a rotating extent of the spun yarn between the mouth of the yarn guide tube and the inner wall of the spinning centrifuge is caught by the slot at the foot of the winding tube causing the spun yarn to wind onto the winding tube as the spinning centrifuge rotates and causing a remnant extent of the spun yarn trailing the rotating yarn extent to be separated from the spun yarn body for subsequent removal, preferably by a suction device.

In a preferred embodiment of the present invention, separation of the remnant of spinning yarn occurs by cutting. Separation may also occur when the rotating yarn extent is held and tensioned, for example, between rollers of a preceding draw frame and the rotating extent of the yarn caught by the winding tube. Furthermore, according to another preferred embodiment of the present invention, separation may also occur as a result of a separating device which can be regulated by means of relative motion between the winding tube and the yarn guide tube. For example, separation may be accomplished by means of rotary motion of a separating device about an axis of rotation coinciding with a common longitudinal axis of the winding tube and the yarn guide tube. Other advantageous embodiments of the method and the device of the present invention are set forth in more detail herein.

The separation close to the location at which the yarn was grasped by the tube foot, causes the free end of the spinning yarn remaining on the tube foot to be so short that no more adverse influence or disturbance of the functions of the pot spinning machine can emanate from it and from the separated section of spinning yarn completely removed by suction.

As a result of the fact that the separation preferably takes place as a cutting process, a purposeful, clean and reliable separation is possible. The yarn does not tear haphazardly, e.g., at a thin spot, leaving a yarn remnant or free end which continues to disturb. The separation preferably takes place, when the yarn is held and tensioned on one end by the draw-frame rollers and on the other end by the yarn body or the tube, as is the case in the time period between the start of the winding process and the loosening of the yarn from the draw frame. The separation is possible therewith without additional clamping devices. The yarn is sufficiently fixed and tensioned at both ends at the time of the cutting process.

A separating device which can be controlled with advantage by means of the relative motion between the tube and the yarn guide tube and designed as part of a yarn guide assures that the separation of the remnant of the spinning yarn automatically takes place at the start of winding, that is, at the creation of the remnant of the spinning yarn. An additional control can be eliminated. A placing of the remnant of spinning yarn on the spinning centrifuge is excluded by the separation at the start of winding.

The separation takes place in a preferred manner by the rotational motion of a separating device whose axis of rotation is on the imaginary center line forming the common longitudinal axis of the tube and the yarn guide tube. This permits an especially, functionally reliable and purposeful separation directly at the tube slot. The preferable removal by suction by the removal of slubbing by suction represents a simple and effective possibility of removal by suction by the utilization of the suction removal present in the spinning position.

In a further advantageous embodiment of the method of the present invention, the remnant of spinning yarn is separated after the arrival of a traveling doffer at the spinning position by means of a separating device entrained by the traveling doffer and the removal of the remnant of spinning yarn takes place by means of the suction of the traveling doffer. The separation and the removal by suction of the remnant of spinning yarn as a function of the traveling doffer can be carried out with little expense therewith.

In a preferred embodiment, each spinning position comprises a separating device for separating the remnant of spinning yarn from the yarn body and comprises a suction removal device for removing the remnant of spinning yarn separated in this manner. It is possible therewith to eliminate the remnant of spinning yarn immediately at the start of winding and when it is created.

In order to avoid additional suction removal devices and to keep the construction cost low at the spinning position, the removal of slubbing by suction of the pot spinning machine is also designed with preference as a suction removal device for the remnant of spinning yarn.

In further embodiments, the separating device preferably comprises at least one knife which can move in the axial direction of the tube and preferably at least one knife which can rotate about an axis of rotation, which axis of rotation lies on the imaginary center line forming the common longitudinal axis of the tube and of the yarn guide tube. The knife is advantageously designed in the form of a crown. The remnant of spinning yarn can be separated in an especially reliable and purposeful manner with such designs of the separation device of the present invention without the disadvantages of the prior art. This makes possible simple and space-saving constructive solutions such as the arrangement of the separating device inside the tube which does not disturb or hinder the other functions of the pot spinning machine.

The device for pot spinning comprises means for converting the axial relative motion of the yarn guide tube and the tube into the motion of the knife, which means consist especially of a groove running at least partially in a spiral and of a bolt which can move in the groove. An additional drive or an additional drive device is superfluous in this embodiment.

In a further advantageous embodiment of the present invention, at least one separating device for separating the remnant of spinning yarn is arranged on a traveling doffer and the suction removal of the doffer is also designed as a suction removal device for the remnant of spinning yarn. As a result of the arrangement of the separating device on the traveling doffer, the separating devices at each individual spinning position can be eliminated and a lower number of separating devices, which are then significantly less, in a pot spinning machine lowers the expense considerably.

Further details of the invention can be gathered from the following exemplary embodiments illustrated by the drawings.

DESCRIPTION OF THE PREFERRED EMBODIMENTS

Figure 1:
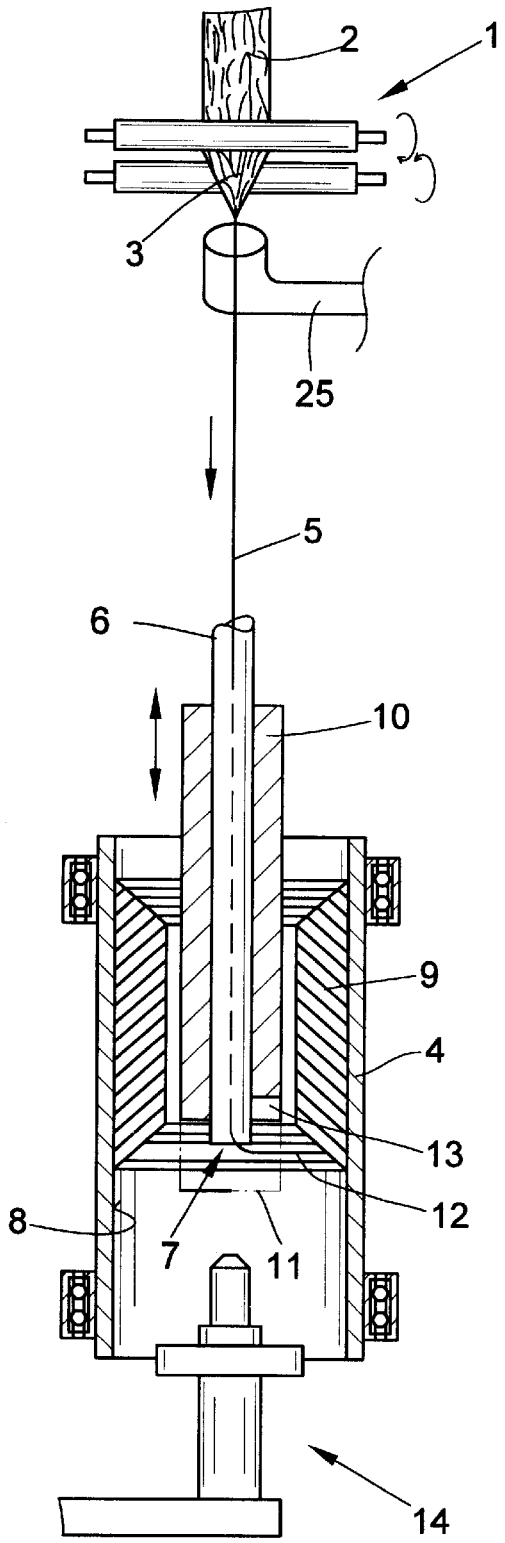
FIG. 1 is a schematic view of a spinning position of a pot spinning machine in partial section.

The spinning position of a pot spinning machine shown in FIG. 1 is in the direction of yarn flow below draw frame 1, as indicated by the last pair of delivery rollers. Sliver 2 is drawn in draw frame 1, and is twisted together in spinning triangle 3 under the action of rotating spinning centrifuge 4 into a yarn 5. Yarn 5 is introduced into spinning centrifuge 4 through yarn guide tube 6 designed as part of a yarn guide. Yarn 5, exiting out of mouth 7 of yarn guide tube 6, is placed under the action of the rotation of spinning centrifuge 4 on inside wall 8 of spinning centrifuge 4 where it forms yarn body 9. Yarn guide tube 6 performs a traversing motion in axial direction thereby, indicated by the double arrow, which motion regulates the formation of yarn body 9. The position which yarn guide tube 6 assumes in FIG. 1, as well as during the traversing motion, is designated as the spinning position. During the spinning process, a tube 10, thrust over yarn guide tube 6, is located above mouth 7 of yarn guide tube 6.

In order to initiate the winding process, tube 10 is lowered below mouth 7 of yarn guide tube 6 into rewinding position 11, shown by the dotted lines. The rotating extent 12 of the yarn is caught by slot 13 on the foot of tube 10 and fixed in such a manner that yarn body 9 is automatically wound onto tube 10 as spinning centrifuge 4 rotates further. Wound tube 10 can be subsequently placed on transport plate 14 held ready below spinning centrifuge 4 and can be removed together with transport plate 14 for further processing.

Figure 2:
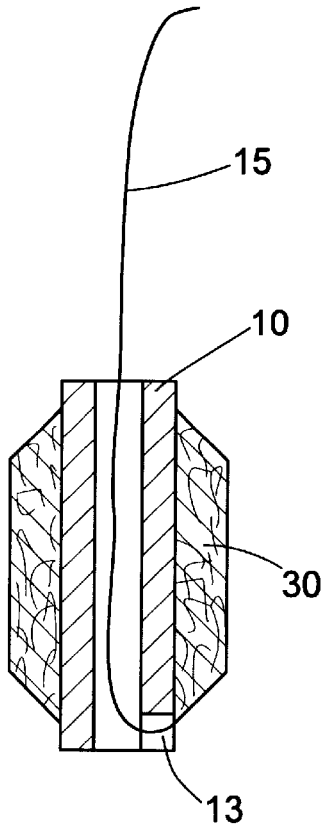
FIG. 2 is a simplified view of a section of tube with covered yarn body.

Tube 10 with yarn body 30 is formed. FIG. 2 depicts a wound tube 10. As a result of the catching of yarn 5 in slot 13, no more twist is imparted to yarn 5 and, hence, yarn 5 is separated from sliver 2 below draw frame 1. A separation by a clamping and cutting device directly below draw frame 1, as is disclosed in German Patent Publication DE 43 24 039 A1, can also take place. The trailing free end of yarn 5 forms remnant of spinning yarn 15, which can be approximately half a meter long.

Remnant of spinning yarn 15 remains fixed by one end on tube 10. Remnant of spinning yarn 15 can cause problems with the other loose end in the spinning position during removal or during further processing.

Figure 3:
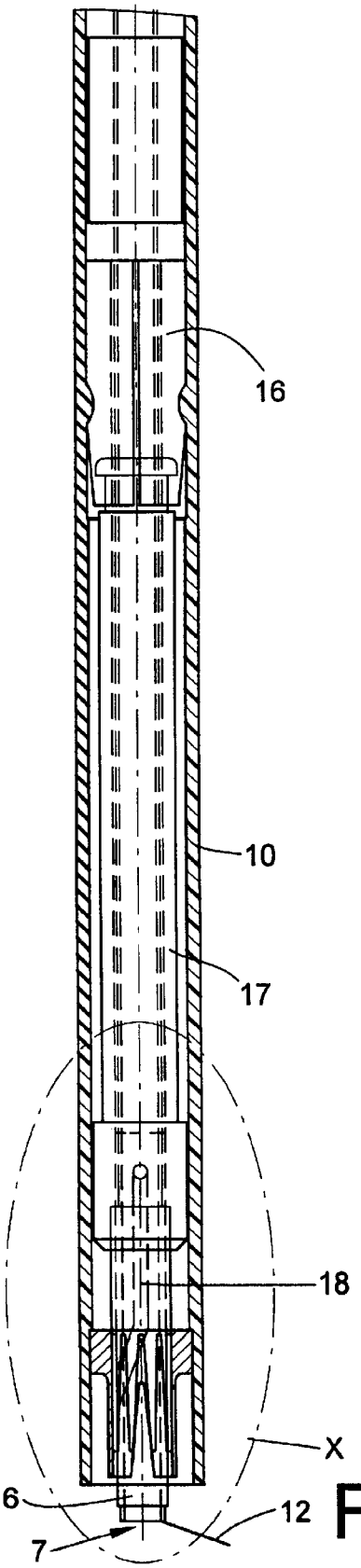
FIG. 3 is a yarn guide tube in a guide in spinning position with holder, tube and separating device in partial section.

FIG. 3 shows a part of yarn guide tube 6 whose lower end extends into spinning centrifuge 4. Yarn guide tube 6 is held in guide 17 in such a manner that it can shift axially. Wound tube 10 is fixed in its position during the spinning process by a releasable connection effected by holder 16. Guide 17 is arranged in the inside of tube 10 and supported in holder 16 in such a manner that it can rotate about center line 18 coinciding with the longitudinal axis. Guide 17 cannot shift in the axial direction relative to holder 16.

Mouth 7 of yarn guide tube 6 extends past the end of tube 10 and yarn shank 12 can rotate in an unimpeded manner. Tube holder 16 and guide 17 together with yarn guide tube 6 execute the traversing up-and-down motion during the spinning process without the position of these parts changing relative to each other.

Figure 4:
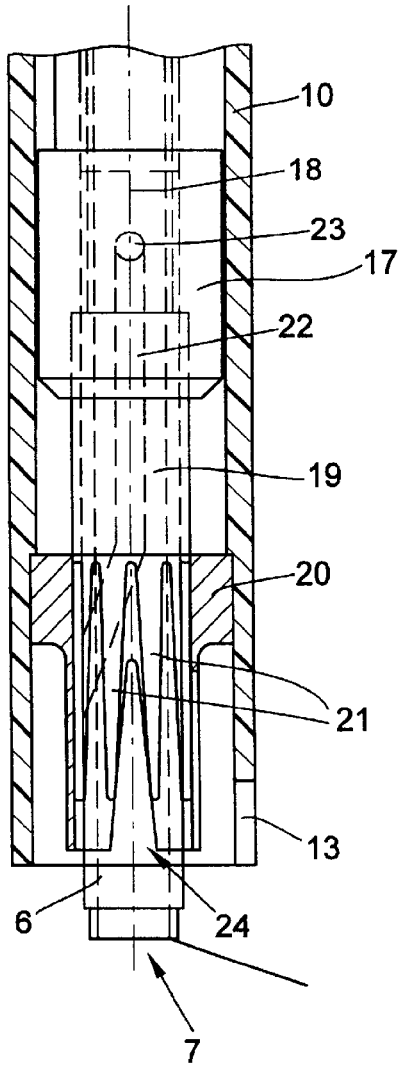
FIG. 4 is an enlarged view of detail X in FIG. 3.

Knife 19, permanently connected to guide 17, is located in the lower part of tube 10. Knife 19 is guided in counterpart 20 connected permanently for its part to the tube. Knife 19 is designed at its lower end like a crown and can execute a rotary motion about center axis 18 with prongs 21 of the crown-shaped part in counterpart 20. Detail X of FIG. 3 is shown on an enlarged scale in FIG. 4.

Yarn guide tube 6 comprises groove 22 in its lower part which groove at first runs parallel to center line 18 and is designed to run in a spiral toward the lower end of yarn guide tube 6. Bolt 23, permanently connected to guide 17, engages into groove 22 and can shift in the latter.

The winding process is initiated by lowering tube 10 downward over mouth 7 of yarn guide tube 6. When the lower edge of tube 10 reaches rotating yarn shank 12, the latter is caught and fixed by slot 13. The winding process automatically begins therewith, caused by spinning centrifuge 4, which continues to rotate.

Figure 5:
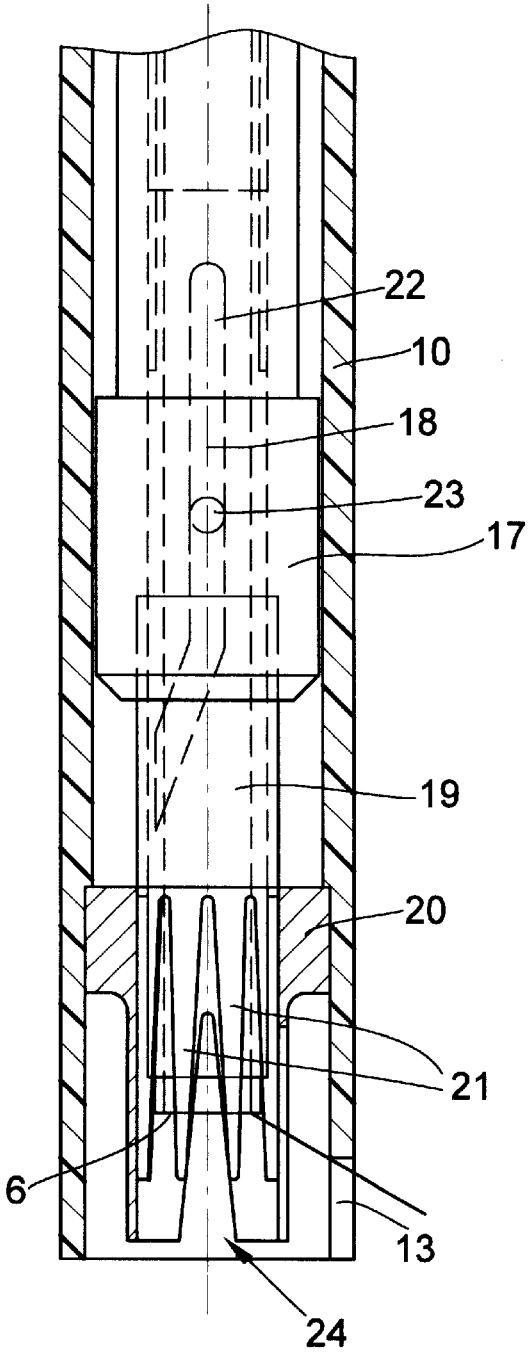
FIG. 5 is the lower part of the tube corresponding to FIG. 4 but in winding position.

FIG. 5 shows rewinding position 11 of tube 10. Tube 10 has changed its position in axial direction relative to yarn guide tube 6 in common with holder 16 and guide 17 together with knife 19 fastened on guide 17 and with counterpart 20 fastened on tube 10. Bolt 23 has also changed its position downward by the corresponding length of path. Yarn guide tube 6 and tube 10 are held in such a manner that neither one executes a rotational movement about center line 18.

Figure 6:
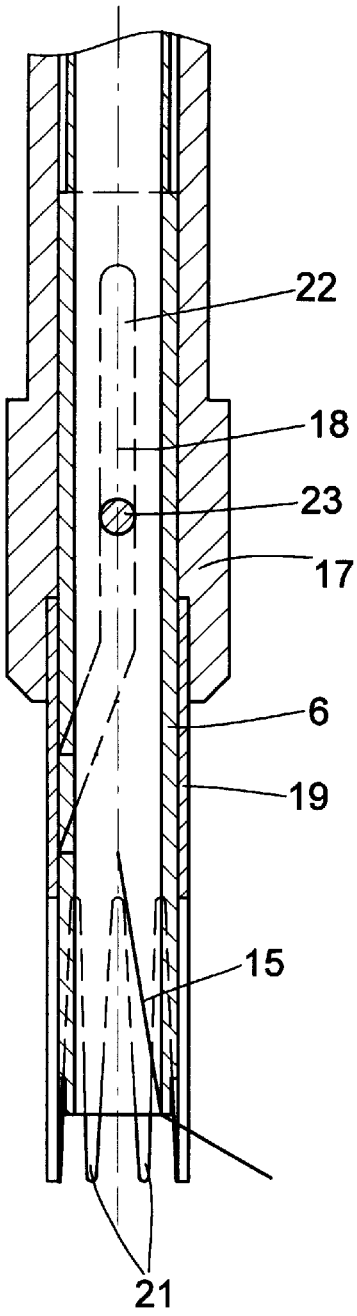
FIG. 6 is a sectional view of guide and of yarn guide tube in the winding position of FIG. 5.

Further details in this position can be recognized from the sectional view of FIG. 6. In the further downward movement of tube 10, bolt 23 reaches the spiral part of groove 22 and brings about a rotary movement of guide 17 and therewith of knife 19 around center axis 18. Yarn 5, which is held between draw frame 1 and yarn body 30 on tube 10 and runs between two prongs 21 of knife 19 and through notch 24 of counterpart 20, is separated by the cutting action of knife 19 and counterpart 20. Remnant of spinning yarn 15 is removed by the slubbing suction removal functioning as suction removal device 25.

Figure 7:
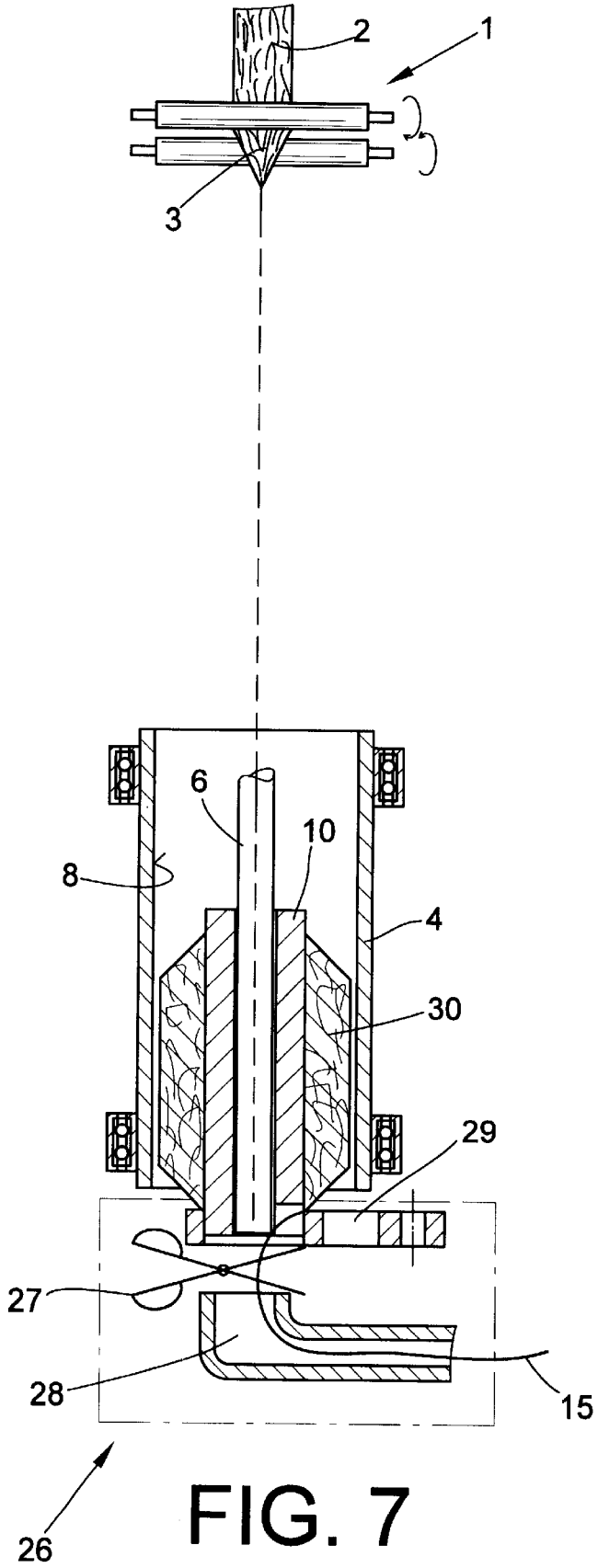
FIG. 7 is a schematic view of a spinning position of a pot spinning machine and a doffer provided with separating device and suction removal device.

The doffing can also take place progressively in unordered sequence by traveling doffer 26. The view of FIG. 7 shows a traveling doffer 26 comprising cutting device 27, suction removal device 28 and catching device 29 for drawing off wound tube 10 and placing on a tube 10 held ready as an empty tube. After traveling doffer 26 has reached the spinning position, catching device 29 catches the foot of wound tube 10, suction removal device 28 sucks in remnant of spinning yarn 15, which loosened in the meantime at spinning triangle 3 from yarn 2, and cutting device 27 separates remnant of spinning yarn 15 directly at the foot of wound tube 10.

The subject matter of the invention is not limited to the exemplary embodiments shown in the Figures. Further embodiments, for example of a holder and of a guide, are possible.

Knife 19 can also cut off remnant of spinning yarn 15 in direct cooperation with slot 13 of tube 10, during which slot 13 functions as a notch 24 of counterpart 20.

Details of the drive and of the holding of the yarn guide tube, tube, tube holding and guide which are not described herein can be designed in accordance with the state of the art as is apparent, for example in German Patent Publications DE 195 20 153 A1 or DE 43 24 039 A1.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for winding a body of a spun yarn from an inner wall of a rotating spinning centrifuge of a pot spinning machine onto a winding tube having a slot at a foot thereof, wherein the winding tube surrounds a yarn guide tube having a leading end extending into the spinning centrifuge with a mouth at the leading end from which mouth the spun yarn travels to the inner wall of the spinning centrifuge, the method comprising:

a) inserting the foot of the winding tube into the spinning centrifuge beyond the mouth of the yarn guide tube, b) catching a rotating extent of the spun yarn between the mouth of the yarn guide tube and the inner wall of the spinning centrifuge, by the slot at the foot of the winding tube to initiate winding of the body of the spun yarn onto the winding tube as the spinning centrifuge rotates and to separate from the body of the spun yarn on the winding tube near the slot at the foot of the winding tube a remnant extent of the spun yarn trailing the rotating extent thereof; and c) removing the separated trailing remnant extent of the spun yarn.

2. The method according to claim 1, wherein the catching of the rotating extent of the spun yarn comprises cutting of the trailing remnant extent of the spun yarn.

3. The method according to claim 1, wherein the catching of the rotating extent of the spun yarn comprises tensioning the trailing remnant extent of the spun yarn sufficiently to separate from the rotating extent of the spun yarn.

4. The method according to claim 1, and further comprising providing a separating device operable for separating the spun yarn by relative motion between the winding tube and the yarn guide tube.

5. The method according to claim 4, and further comprising rotating the separating device about an axis of rotation coinciding with a common longitudinal axis of the winding tube and the yarn guide tube.

6. The method according to claim 1, wherein the removing of the separated trailing remnant extent of the spun yarn occurs by suction.

7. The method according to claim 6, wherein the removing by suction occurs by slubbing suction removal and further comprising providing a suction removal device for disposal of yarn slubs and the trailing remnant extent of the spun yarn.

8. The method according to claim 1, and further comprising providing a service unit for traveling between multiple spinning centrifuges of the pot spinning machine, including providing the service unit with a device for separating the trailing remnant extent of the yarn and a suction removal device for removing the separated trailing remnant extent of the spun yarn.

9. A pot spinning machine comprising:

a) a rotating spinning centrifuge having an inner wall upon which a body of a spun yarn is formed, b) a yarn guide tube having a leading end extending into the rotating spinning centrifuge with a mouth at the leading end from which mouth a spun yarn travels to the inner wall of the rotating spinning centrifuge, c) a winding tube having a foot, d) a means for inserting the foot of the winding tube into the rotating spinning centrifuge beyond the mouth of the yarn guide tube, e) a means for catching a rotating extent of the spun yarn between the mouth of the yarn guide tube and the inner wall of the rotating spinning centrifuge, wherein the rotating extent of the spun yarn is trailed by a remnant extent of the spun yarn, f) at least one cutting device for separating the remnant extent of the spun yarn from the body of the spun yarn, and g) a means for removing the separated remnant extent of the spun yarn.

10. The pot spinning machine according to claim 9, and further comprising multiple spinning positions each comprising a separating device for separating the trailing remnant extent of the spun yarn from the body of spun yarn and comprises a suction removal device for removing the separated trailing remnant extent of the spun yarn.

11. The pot spinning machine according to claim 9, and further comprising a suction-operated slub removal device arranged for removal of the trailing remnant extent of the spun yarn.

12. The pot spinning machine according to claim 10, wherein the separating device comprises at least one knife movable axially relative to the winding tube.

13. The pot spinning machine according to claim 10, wherein the separating device comprises at least one knife rotatable about an axis of rotation coinciding with a common longitudinal axis of the winding tube and the yarn guide tube.

14. The pot spinning machine according to claim 12, wherein the knife has a crown-like shape.

15. The pot spinning machine according to claim 13, and further comprising a means for converting the axial relative motion of the yarn guide tube and the winding tube into rotation of the knife, wherein the means comprises a partially spiral groove and a bolt movable in the groove.

16. The pot spinning machine according to claim 9, and further comprising a traveling doffer for traveling between multiple spinning centrifuges of the pot spinning machine wherein the traveling doffer includes a device for separating the trailing remnant extent of the spun yarn and a suction removal device for removing the separated trailing remnant extent of the spun yarn.

* * * * *